US012643023B2

(12) United States Patent
Chen

(10) Patent No.: US 12,643,023 B2
(45) Date of Patent: Jun. 2, 2026

(54) KIND OF CHILDREN'S DOUBLE FOLDING BASKETBALL SHOOTING FRAME

(71) Applicant: Chao Chen, Shantou (CN)

(72) Inventor: Chao Chen, Shantou (CN)

( * ) Notice: Subject to any disclaimer, the term of this patent is extended or adjusted under 35 U.S.C. 154(b) by 433 days.

(21) Appl. No.: 18/335,422

(22) Filed: Jun. 15, 2023

(65) Prior Publication Data

US 2024/0399225 A1 Dec. 5, 2024

(30) Foreign Application Priority Data

Jun. 2, 2023 (CN) ..... 202321402281.4

(51) Int. Cl.
*A63B 63/08* (2006.01)
*A63B 71/06* (2006.01)

(52) U.S. Cl.
CPC ..... *A63B 63/083* (2013.01); *A63B 71/0669* (2013.01); *A63B 2210/50* (2013.01); *A63B 2220/80* (2013.01); *A63B 2225/74* (2020.08)

(58) Field of Classification Search
CPC ..... A63B 63/083; A63B 71/0669; A63B 2225/74; A63B 2210/50; A63B 2220/80
USPC ..... 473/481
See application file for complete search history.

(56) References Cited

U.S. PATENT DOCUMENTS 4,239,214 A * 12/1980 Brenner ..... A63B 63/083 273/342
4,266,763 A * 5/1981 Collins ..... A63B 63/083 473/481
4,973,054 A * 11/1990 Metrosky ..... A63B 21/1663 473/481
6,338,686 B1 * 1/2002 King ..... A63B 71/0669 473/415
7,281,999 B1 * 10/2007 Miller ..... A63B 63/083 D21/705
8,371,965 B2 * 2/2013 Quinn ..... A63B 63/083 473/487
11,364,426 B2 * 6/2022 Brown ..... A63B 71/0622
2016/0082330 A1 * 3/2016 Barnes ..... A63B 63/083 473/481
2016/0193518 A1 * 7/2016 Baxter ..... A63B 21/0442 473/483
2024/0108958 A1 * 4/2024 Bush ..... A63B 63/083

* cited by examiner

*Primary Examiner* — Michael G Lee
(74) *Attorney, Agent, or Firm* — Nicholas Makridakis

(57) ABSTRACT

The present application publishes a children's double folding basketball hoop, including two backboards, whose walls ware rotating connected, each backboard bottom has a basketball hoop. The basketball hoop is connected with the bottom of the backboards through the folding structure, and the basketball hoop is parallel to the backboards when the folding structure is folded, and the basketball hoop is perpendicular to the backboards while unfolded. Its advantage is that the side walls of the two backboards are connected by rotation, and the two backboards can be folded together, and the same for basketball hoop and backboards, with small size, easy to pack and transport; when needed, basketball hoop and backboards are unfolded, it is convenient for double play. When not in use, the two backboards can be folded together, and the same for basketball hoop and backboards, with small size, convenient for storage.

5 Claims, 7 Drawing Sheets

KIND OF CHILDREN'S DOUBLE FOLDING BASKETBALL SHOOTING FRAME

CROSS-REFERENCE TO RELATED APPLICATIONS

This application claims the benefit and priority of Chinese patent application No. 202321402281.4 filed on Jun. 2, 2023, disclosure of which is hereby incorporated by reference in its entirety.

TECHNICAL FIELD

The present application relates to the technical field of sporting goods technology, in particular, a children's double folding basketball shooting frame.

BACKGROUND

Children's basketball hoop is generally small in size, hanging on the door frame, which can be convenient for children to shoot, the current children's basketball hoop includes backboard and basketball hoop, basketball hoop is installed under the backboard, basketball hoop is set vertically with the backboard; this basketball hoop and backboard need to be installed on site by the user, which is not convenient to use, and when finished, the volume is relatively large and inconvenient to store because basketball hoop and backboard are set vertically; when two small children play shooting competition, they cannot shoot the ball at the same time, only one can shoot first and one can shoot later, which delays the time when shooting successively It also requires additional scorekeeping.

SUMMARY

The purpose of the present application is to solve the shortcomings of the prior art and provide a children's double folding basketball shooting frame.

A technical solution of the present application:

A children's double folding shooting basketball frame, including two backboards, the side walls of the two backboards are rotatingly connected to each other, the bottom of each backboard is provided with a basketball hoop, the basketball hoop is connected to the bottom of the backboard through a folding structure provided, said folding structure is folded basketball hoop is parallel to the backboard after the folding structure is folded, and the basketball hoop is perpendicular to the backboard after the folding structure is unfolded.

A preferred option is that said children's double folding basketball hoop also includes a sensor and a display, each backboard is provided with a sensor at the bottom, the sensor is set below the basketball hoop, said display is detachably set at the connection of two backboards, the display is provided with a left scorer, a right scorer and a time display, one sensor is connected to the One sensor is connected to the left scorer and the other sensor is connected to the right scorer.

A preferred solution is that each backboard is provided with a display box in the middle, and the display box is provided with a light bar, and said light bar is connected to the time display.

A preferred option is that the children's double folding shooting basketball frame also includes a number of hooks, the bottom of the hook is connected to the backboard, and the other end is used to hang with the door frame.

A preferred option is that said folding structure includes a mounting plate, a folding plate, a pivot, a torsion spring and a support rod; said folding plate includes a backboard, and a first side plate provided on the left and right sides of the backboard, said front side of the backboard is fixedly connected to the basketball hoop, said mounting plate includes a fixed plate, and a second side plate located on the left and right sides of the fixed plate, said fixed plate is fixedly connected to the said backboard is fixedly connected, said spindle passes through the first side plate and the second side plate in turn and is rotatably connected to the first side plate and the second side plate, said torsion spring is located outside the spindle, said torsion spring includes a first spring body, a second spring body, a toggle bar, a first spring torsion bar and a second spring torsion bar, said toggle bar is in contact with the inner surface of the backboard, said first spring torsion bar and second spring torsion bar are in contact with the inner surface of the fixed plate; said first side plate is provided with a vertical slide, said second side plate is provided with a first arc slide, said first arc slide is provided with a groove at the bottom; said left end of the support rod passes through the first arc slide and vertical slide on the left side, and the right end passes through the first arc slide and vertical slide on the right side.

Combined with the above technical solutions, the beneficial effect of the present application: the two backboards are connected by rotation between the side walls of the two backboards, the two backboards can be folded together, basketball hoop and backboard can be folded together, small size, convenient for packaging and transportation of the present application; when in need of use, the two backboards are unfolded, the basketball hoop and backboard unfold, convenient for two-person pitching game or training use; when not in use, two backboard can be folded together, basketball hoop and backboard can be folded together, small size, convenient for storage.

The above description is only an overview of the technical solution of the present application, in order to understand the technical means of the present application more clearly, and can be implemented in accordance with the contents of the specification, and in order to make the above and other purposes, features and advantages of the present application can be more obvious and easy to understand, the following is a better example, and with the attached drawings, detailed description as follows.

DETAILED DESCRIPTION

To illustrate the idea and purpose of the present application, the following will be combined with the accompanying drawings and specific examples of the present application for further explanation.

Figure 1:
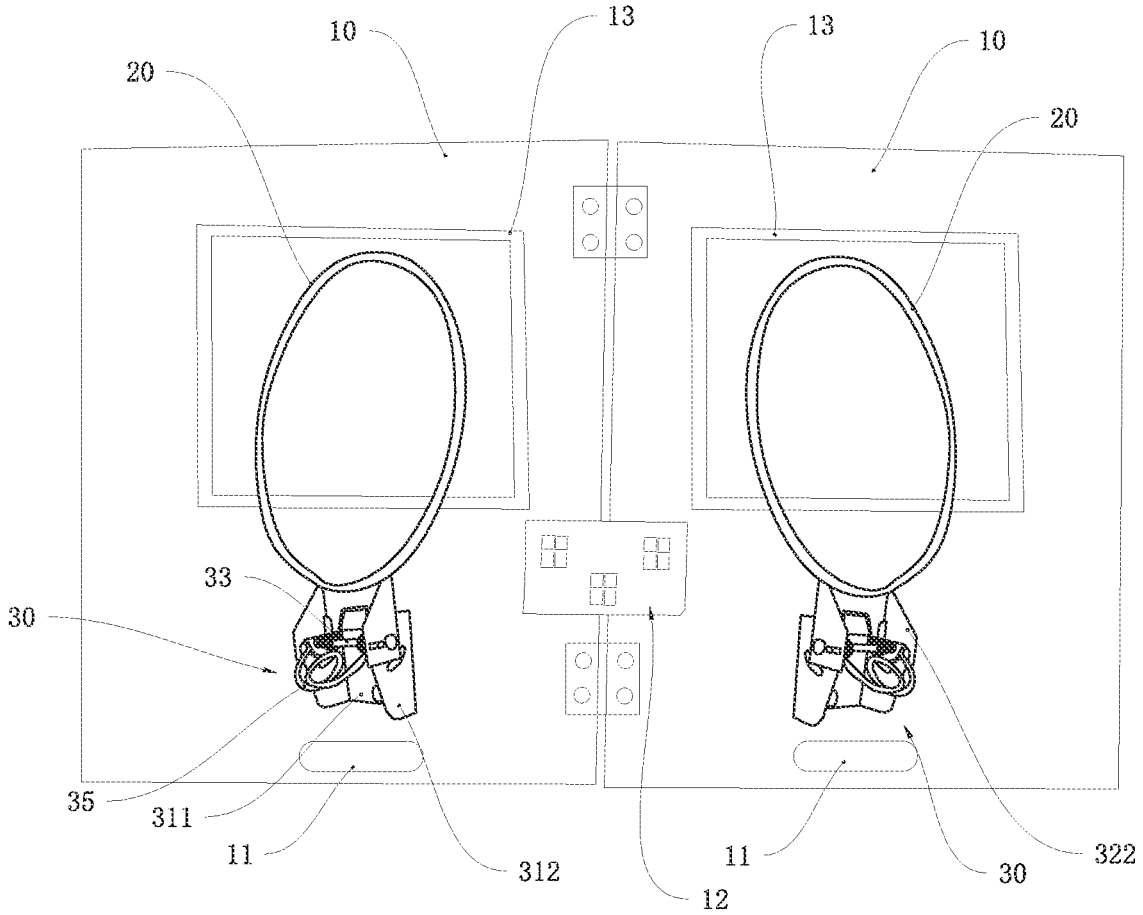
FIG. 1 is a schematic view of the two backboards in the present application when they are unfolded.
Figure 2:
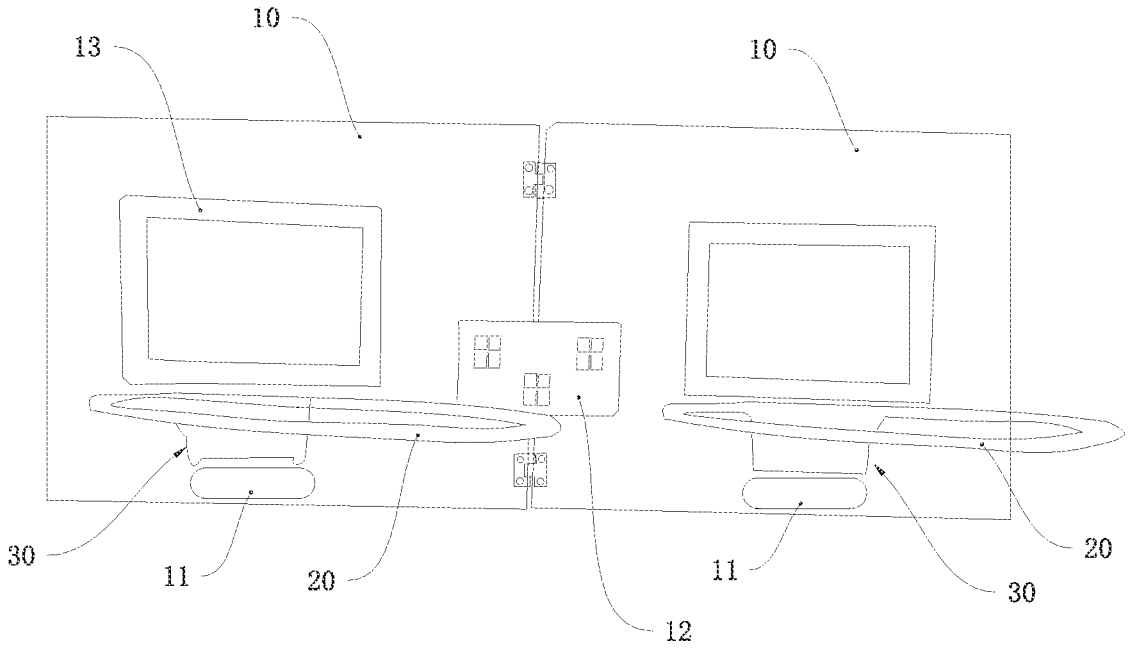
FIG. 2 is a schematic diagram I of the two basketball hoops in the present application when they are unfolded.
Figure 3:
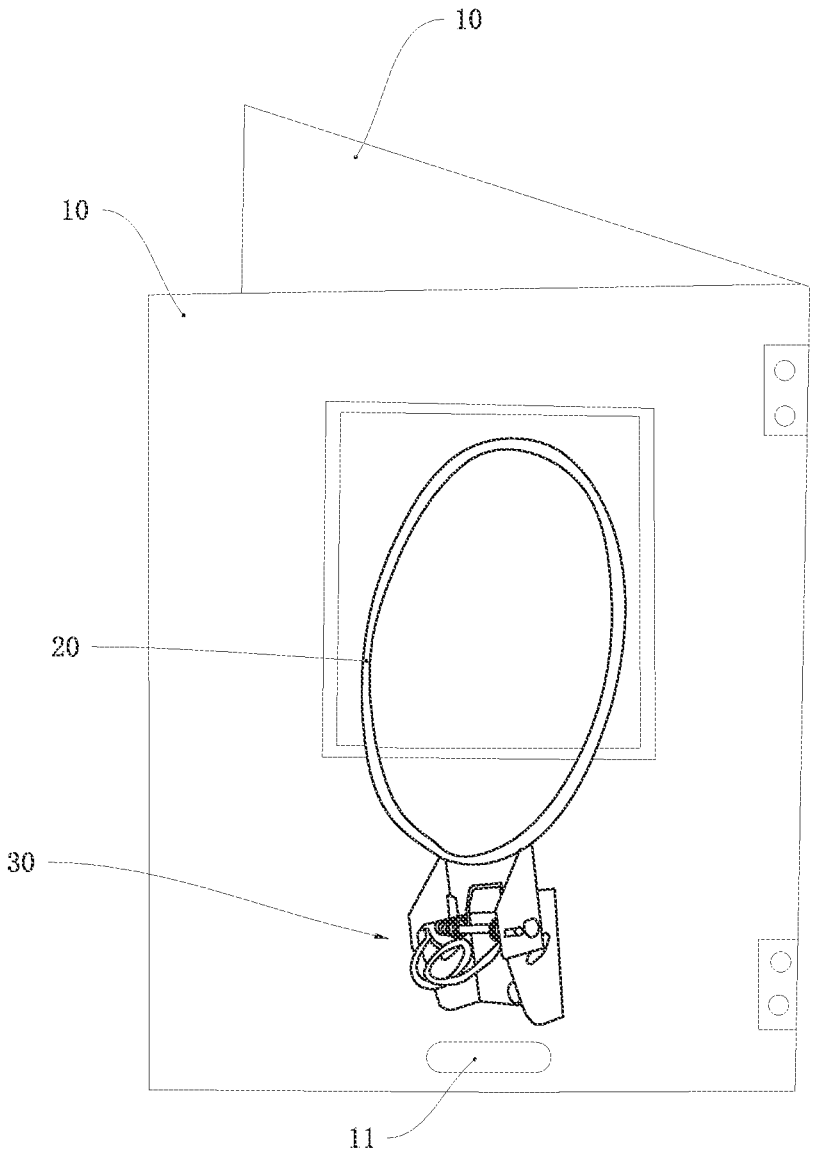
FIG. 3 is a schematic diagram of the two backboards in the present application when folded I.
Figure 4:
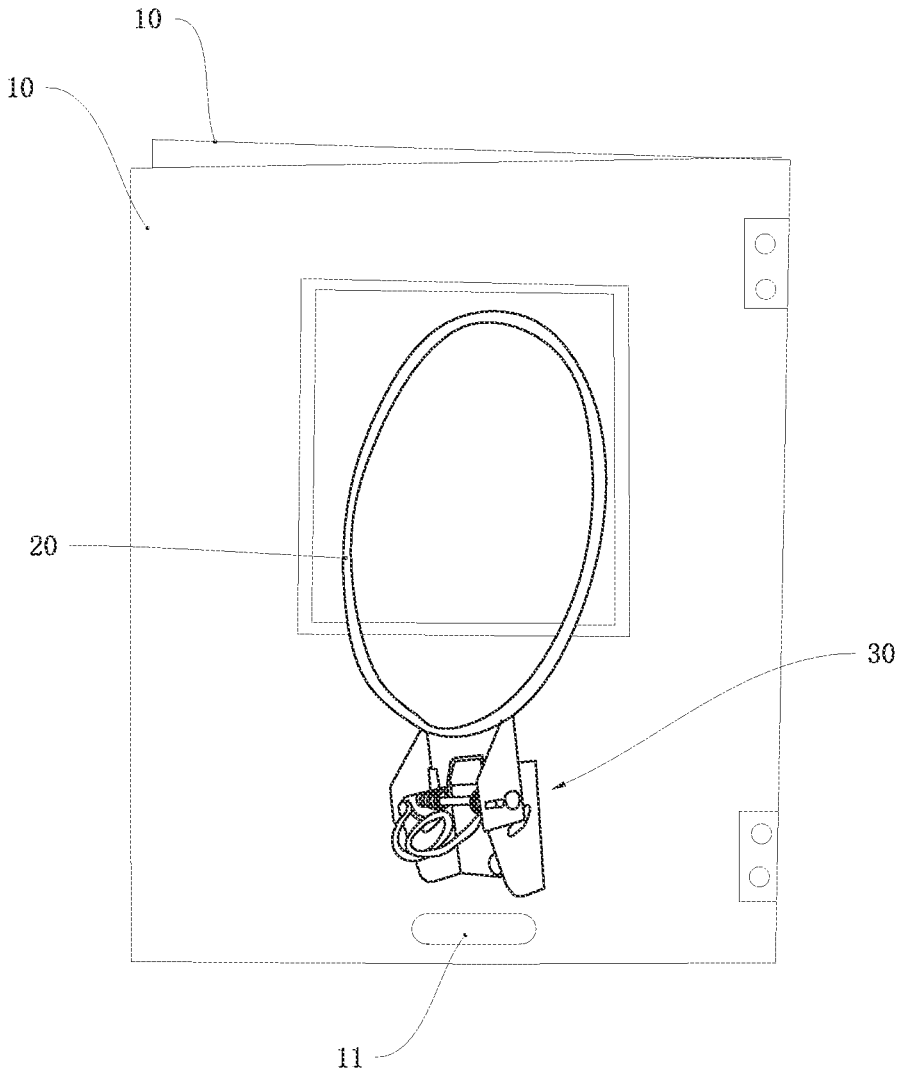
FIG. 4 is a schematic diagram of the two backboards in the present application when folded II.
Figure 5:
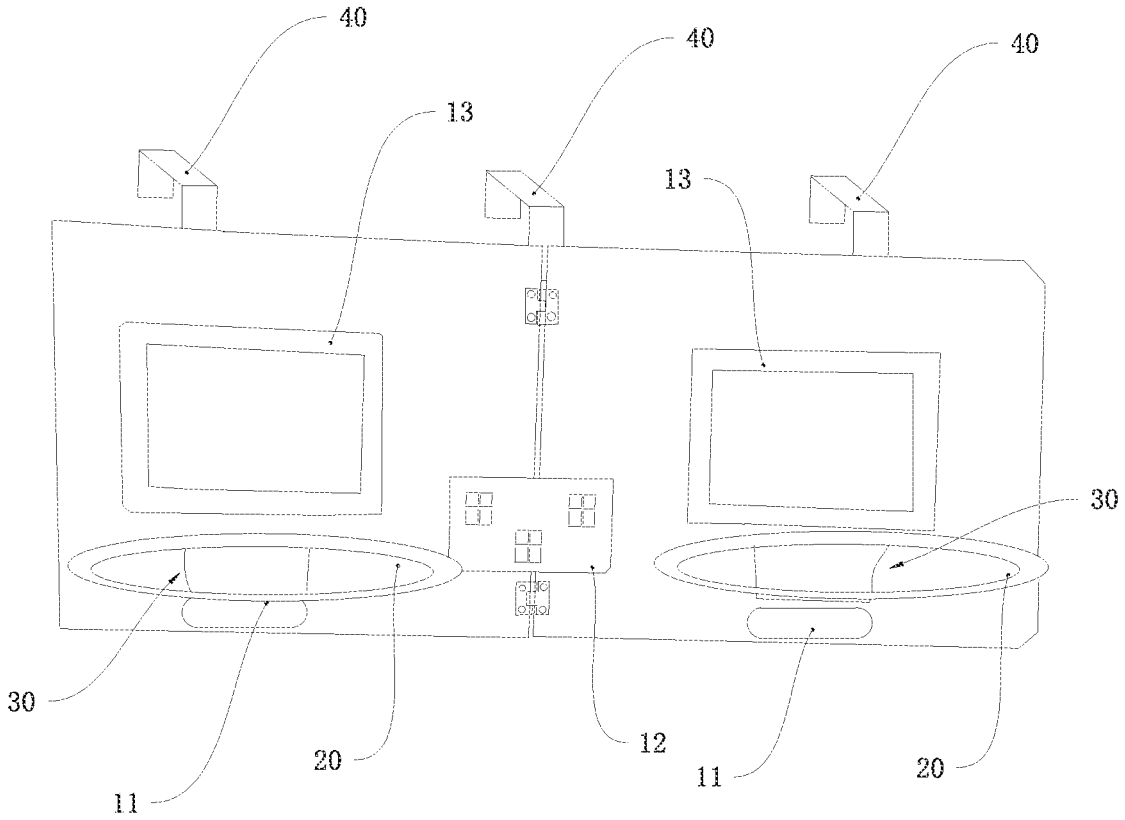
FIG. 5 is a schematic diagram II of the two basketball hoops in the present application when they are unfolded.
Figure 6:
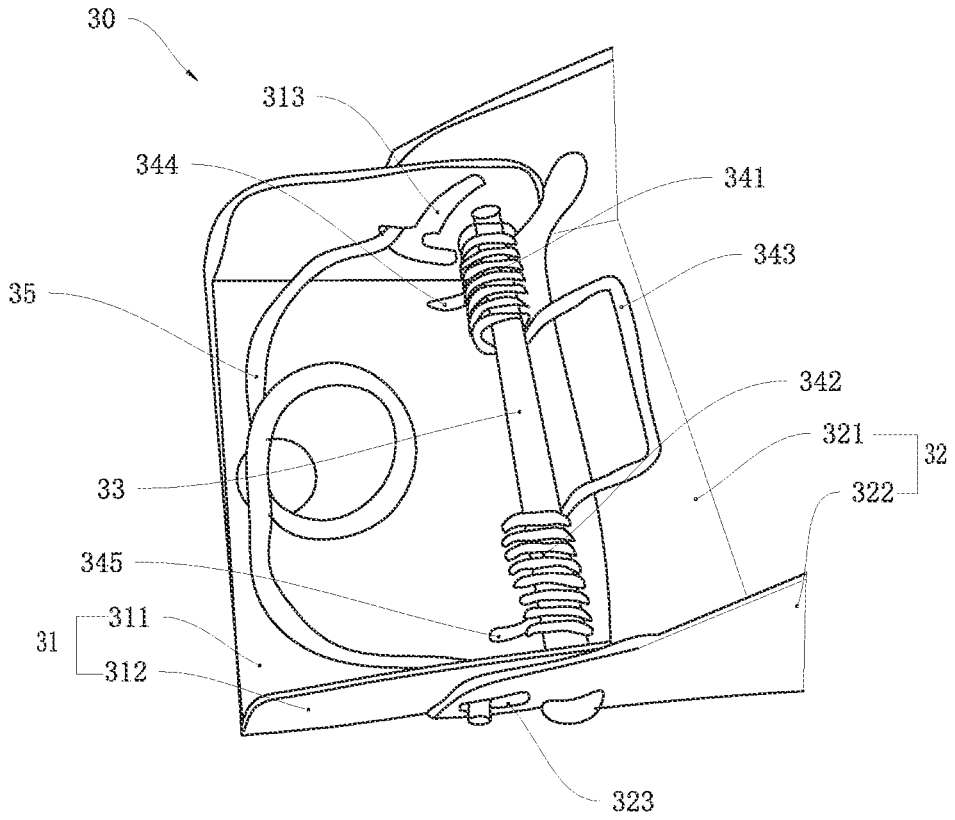
FIG. 6 is a schematic diagram of the folding structure in the present application.
Figure 7:
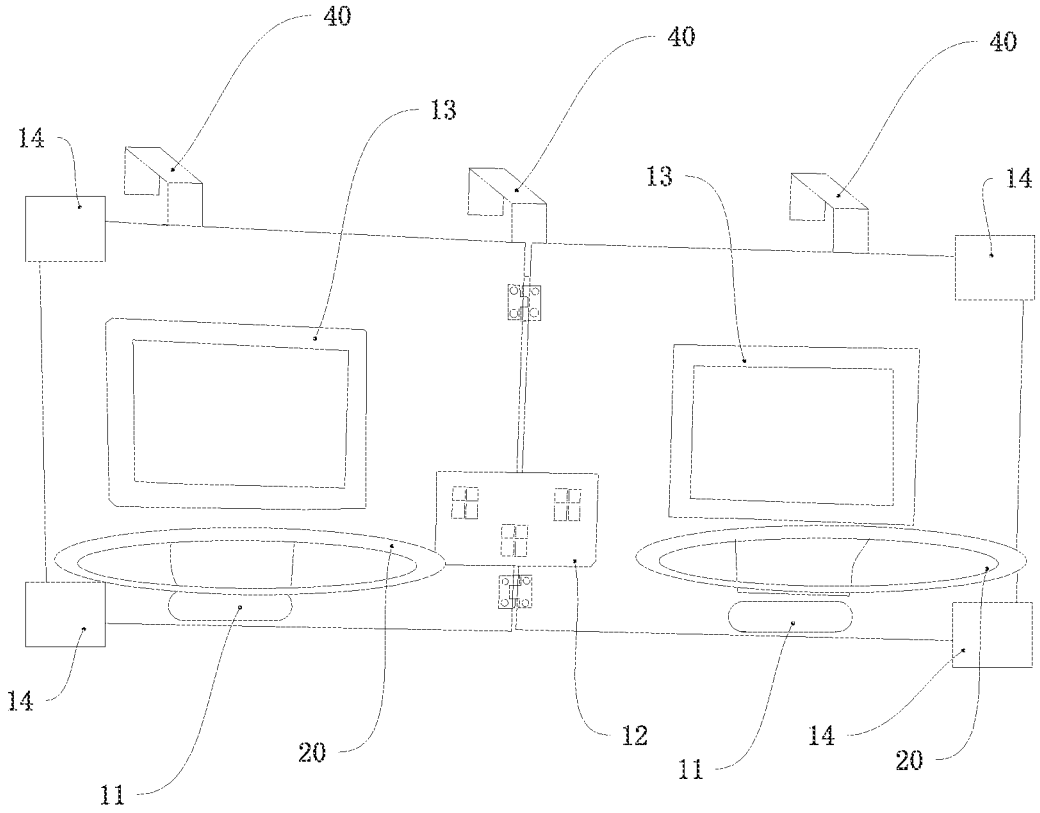
FIG. 7 is a schematic diagram III of the two basketball hoops in this present application when they are unfolded.

As shown in FIGS. 1 to 7, a children's two-person folding shooting basketball frame includes two backboards 10, the side walls of the two backboards 10 are rotatably connected to each other, the bottom of each backboard 10 is provided with a basketball hoop 20, the basketball hoop 20 is connected to the bottom of the backboard 10 by a folding structure 30 provided with The basketball hoop 20 is connected to the bottom of the backboard 10 by a folding structure 30, said folding structure 30 is folded and the basketball hoop 20 is parallel to the backboard 10, and the folding structure 30 is unfolded and the basketball hoop 20 is perpendicular to the backboard 10.

As shown in FIG. 1 to FIG. 7, the side walls of the two backboards 10 are rotatingly connected to each other, and the two backboards 10 can be folded together. basketball hoop 20 and backboard 10 can be folded together in a small size, which is convenient for the packaging and transportation of the present application; when installation is needed, the two backboards 10 are unfolded. basketball hoop 20 and backboard 10 unfold, which is convenient for two-person pitching games or training use. The side walls of the two backboard 10 are connected by hinges rotating between them, when not needed to use, backboard 10 folded together, when needed to use, the two backboard 10 unfolded to facilitate two children to throw the basketball.

As shown in FIGS. 1 to 7, said children's double folding shooting basketball hoop also includes a sensor 11 and a display 12, the bottom of each backboard 10 is provided with a sensor 11, the sensor 11 is set below the basketball hoop 20, said display 12 is detachably set at the connection of the two backboards 10, the display 12 is provided with a left One sensor 11 is connected to the left scorer and the other sensor 11 is connected to the right scorer. When a ball is thrown in, the sensor 11 can sense the basketball, and the sensor 11 transmits the signal to the display 12, and the left scorer or right scorer in the display 12 can note the number of balls thrown in.

As shown in FIG. 1 to FIG. 7, the left scorer can record the score of basketball hoop 20 on the left side and the right scorer can record the score of basketball hoop 20 on the right side for ease of use.

As shown in FIGS. 1 to 7, each backboard 10 is provided with a display frame 13 in the middle, and the display frame 13 is provided with a light bar, and said light bar is connected to a time display. The color of the light bar is changed, and the color of the light bar changes when the ball is thrown.

As shown in FIGS. 1 to 7, the said children's double folding basketball shooting frame also includes a number of hooks, the bottom of which is connected to the backboard 10 and the other end is used to hang with the door frame. The hooks are convenient for the present application to hang on the door frame, convenient for children to shoot baskets.

In some embodiments, as shown in FIGS. 1 to 7, said folding structure 30 includes a mounting plate 31, a folding plate 32, a pivot 33, a torsion spring and a support rod 35; said folding plate 32 includes a backboard 321, and a first side plate 322 disposed on the left and right sides of the backboard 321, said front side of the backboard 321 is fixedly connected to the basketball hoop, said mounting plate 31 comprises a fixed plate 311, and a second side plate 312 on the left and right sides of the fixed plate 311, said fixed plate 311 is fixedly connected to the backboard 10, said shaft 33 passes through the first side plate 322 and the second side plate 312 in turn and is rotatably connected to the first side plate 322 and the second side plate 312, said torsion spring is located outside the shaft 33, said torsion spring comprises a first spring body 341, second spring body 342, toggle bar 343, first spring torsion bar 344 and second spring torsion bar 345, said toggle bar 343 is in contact with the inner surface of the back plate 321, said first spring torsion bar 344 and second spring torsion bar 345 are in contact with the inner surface of the fixed plate 311; said first side plate 322 is provided with a vertical slide 323, said second side plate 312 is provided with a first curved slide 313, and the bottom of said first curved slide 313 is provided with a groove; the left end of said support rod 35 passes through the first curved slide 313 and vertical slide 323 on the left side, and the right end passes through the first curved slide 313 and vertical slide 323 on the right side.

As shown in FIGS. 1 to 7, the back of the backboard 10 is bonded with a cushion 14. When the present application is hung on the door frame, the cushion 14 is in contact with the door frame and plays a cushioning role.

The above is the specific implementation of the present application, it should be noted that for the ordinary technical person in the art, without departing from the premise of the principle of the present application, a number of improvements and embellishments can be made, and these improvements and embellishments are also regarded as the scope of protection of the present application.

What is claimed is:

1. A children's double folding basketball hoop, characterized in, comprising first and second backboards, side walls of said first and second backboards being rotatably connected to each other, a bottom of said first and second backboard being provided with a basketball hoop, said basketball hoop is connected to said bottom of said first and second backboards by a folding structure provided, said folding structure is folded with said first and second basketball hoops parallel to said first and second backboards, said folded structure is unfolded with said first and second basketball hoops perpendicular to said first and second backboards.

2. The children's double folding basketball hoop according to claim 1, characterized in that said children's double folding basketball hoop further comprises a sensor and a display, said sensor being provided at a bottom of said first and second backboard, said sensor being set underneath said first and second basketball hoops, said display being detachably set at said bottom of said first and second backboards detachable set at a connection of said first and second backboards, said display is provided with a left scorer, a right scorer and a time display, one sensor is connected to said left scorer and a second sensor which is connected to said right scorer.

3. The children's double folding basketball shooting frame according to claim 2, characterized in that a display box is provided in a middle of said first and second backboards, a light bar is provided in said display box, and said light bar is connected to said time display.

4. The children's double folding shooting basketball frame according to claim 1, characterized in that said children's double folding shooting basketball frame further comprises a number of hooks, said bottom of which is connected to said first and second backboards and an opposing end of said bottom is used to hang to a door frame.

5. The children's double folding basketball hoop according to claim 1, characterized in that said folding structure includes a mounting plate, a folding stack plate, a pivot, a torsion spring and a support rod; said folding stack plate includes a backboard, and a first side panel provided on a left and on a right sides of said first and second backboards, a front side of said first and second backboards being fixedly connected to said mounting plate includes a fixed plate, and a second side panel on said left and said right sides of said fixed plate, said fixed plate is fixedly connected to said first and second backboards, a spindle passes through said first side panel and said second side panel in turn and is connected to the first side panel and the second side panel, said torsion spring is located outside a shaft, said torsion spring includes a first spring body, a second spring body, a toggle bar, a first spring torsion bar and a second spring torsion bar, said toggle bar is in contact with an inner side of said first and second backboards, said first spring torsion bar and said second spring torsion bar are in contact with said inner side of a fixed plate surface; said first side panel is provided with a vertical slide slot, said second side panel is provided with a first arc slide slot, said first arc slide slot is provided with a groove at a bottom; a left end of said support rod passes through said first arc slide slot and said vertical slide slot on a left side and a right end passes through said first arc slide slot and said vertical slide slot on said right side.

* * * * *